United States Patent [19]

Husslein et al.

[11] Patent Number: 4,843,218

[45] Date of Patent: Jun. 27, 1989

[54] HEATING ELEMENT FOR THERMAL HEATING DEVICES, ESPECIALLY COOKING STATIONS

[75] Inventors: Julius Husslein, Vachendorf; Günther Wittauer; Heinz Kotsch, both of Traunreut, all of Fed. Rep. of Germany

[73] Assignee: Bosch-Siemens Hausgeräte GmbH, Munich, Fed. Rep. of Germany

[21] Appl. No.: 243,241

[22] Filed: Sep. 8, 1988

Related U.S. Application Data

[63] Continuation of Ser. No. 944,716, Dec. 22, 1986, abandoned.

[30] Foreign Application Priority Data

Dec. 20, 1985 [DE] Fed. Rep. of Germany ..... 3545442

[51] Int. Cl.[4] ..... H05B 3/72

[52] U.S. Cl. ..... 219/468; 219/457; 219/461; 219/464

[58] Field of Search ..... 219/443, 445, 449, 457, 219/458, 459, 461, 462, 463, 464; 465, 466, 467, 468, 543

[56] References Cited

U.S. PATENT DOCUMENTS

| | | | |
|---|---|---|---|
| 1,090,339 | 3/1914 | Perkins | 219/451 |
| 1,332,526 | 3/1920 | Soden | 219/460 |
| 1,669,005 | 5/1928 | Hustadt | 219/443 |
| 2,675,458 | 4/1954 | Stiles | 219/449 |
| 2,939,807 | 6/1960 | Needham | 219/543 |
| 3,505,498 | 4/1970 | Shevlin | 219/543 |
| 3,567,906 | 3/1971 | Hurko | 219/468 |
| 3,694,627 | 9/1972 | Blatchford | 219/543 |
| 3,885,128 | 5/1975 | Dills | 219/463 |
| 3,895,216 | 7/1975 | Hurko | 219/463 |
| 4,002,883 | 1/1977 | Hurko | 219/464 |
| 4,045,654 | 8/1977 | Eide | 219/449 |
| 4,150,280 | 4/1979 | Hurko | 219/543 |
| 4,410,793 | 10/1983 | Fischer | 219/467 |

FOREIGN PATENT DOCUMENTS

| | | | |
|---|---|---|---|
| 0069298 | 1/1983 | European Pat. Off. | 219/464 |
| 2351249 | 4/1975 | Fed. Rep. of Germany | 219/464 |
| 12984 | 9/1915 | United Kingdom | 219/466 |

*Primary Examiner*—Teresa J. Walberg

*Attorney, Agent, or Firm*—Herbert L. Lerner; Laurence A. Greenberg

[57] ABSTRACT

A heating element for thermal household appliances includes an inherently stable carrier element having a heating surface in close thermal contact with a substance to be heated, and at least one heating resistor in the form of at least one flat heating conductor strip supported by and closely thermally coupled to the carrier element.

6 Claims, 3 Drawing Sheets

HEATING ELEMENT FOR THERMAL HEATING DEVICES, ESPECIALLY COOKING STATIONS

This application is a continuation, of application Ser. No. 944,716, filed Dec. 22, 1986, now abandoned.

The invention relates to a heating element for thermal household appliances, especially for cooking stations, with a carrier element which supports at least one heating resistor and has a heating surface which is in close thermal contact with the substance which is to be heated.

In conventional commercial heating elements of this type a heating conductor in the form of a spirally wound heating wire is disposed in a carrier element on an insulating layer. It is also known to provide several heating resistances of this type, through which different heat output levels can be set by means of a so called seven step switch in either a parallel or series circuit. Such heating elements are relative costly, are difficult to produce and require a considerable structural height of the heating element. In heating elements for other applications it is known to construct a single heating conductor or several heating conductors in the so-called thick film or thick layer paste technique, using thick layer or film pastes and dielectric material which serves as an insulating and carrier layer, onto which the thick layer or thick film pastes for forming the heat conductor strip pathways are applied, such as by burning them in.

It is accordingly an object of the invention to provide a heating element for thermal heating devices, especially cooking stations, which overcomes the hereinafore-mentioned disadvantages of the heretofore-known devices of this general type and to do so in such a way that besides a simple construction which is easy to manufacture and besides a low height profile, a good heating effect is achieved.

With the foregoing and other objects in view there is provided, in accordance with the invention, a heating element for thermal household appliances, especially cooking stations, comprising an inherently or dimentionally stable carrier element having a heating surface in close thermal contact with a substance to be heated, and at least one heating resistor in the form of at least one heating conductor strip or path, constructed according to a flat conductor technique and preferably constructed according to a thick film paste technique, supported by and closely thermally coupled to the carrier element.

The heating element according to the invention provides in a special way that the heat-flow resistance is very small between the very flat heat conductor strips or paths, especially the thick-layer heat conductor strips or paths and the surface which is to be heated. Additionally, the suitably inherently stable configuration of the heating element ensures an optimal coupling of the heating element to the surface which is to be heated, such as a coupling to a cooking station made of stainless steel or directly to the bottom of a cooking pot. Obviously, similar advantages are obtained by the use of such a heating element for other thermal household appliances, such as for heating plates, dishwashers, washing machines, or the like.

In accordance with another feature of the invention, the carrier element is a metal plate having two sides, and including enamel coatings disposed on both of the sides of the metal plate, the at least one heat conductor strip being disposed on one of the enamel coatings. Special advantages are obtained if the carrier element element is provided on both sides with an insulating enamel layer onto which the heating conductor strip or strips are directly applied, for example by printing and subsequent baking or burning-in.

The provision of a coating, for instance an enamel coating on both sides, prevents a one-sided bending of the metallic carrier element from taking place upon the occurrence of high temperatures of the metallic carrier element due to asymmetrical thermal stresses.

In accordance with a further feature of the invention, the carrier element is a cast metal cooking plate made of a material which has a low carbon content and can be readily enamelled. For carrier elements which have sufficiently high mechanical stability, as for example cast cooking plates, a one-sided surface coating or enamel layer is sufficient at those locations where the heating conductor strips are applied. In the case of enamel coating, it is advantageous if the metal plate is formed of a material with a low carbon content, so that the material can be readily enamel coated.

In accordance with again another feature of the invention, the carrier element is a thin dish-shaped sheet metal plate sheet having a plurality of heating areas.

The invention provides the possibility of applying the heating conductor strips directly onto a cooking plate with interposition of an insulating layer. In this case it is advantageous to provide means for preventing the spread of the heat outside from the cooking surfaces, for example, by providing thermal barriers. Such heat barriers can be created in the form of narrowed sections or cutouts in the material.

Such external stabilizing provisions can be omitted if the heating element itself has sufficient stability. This is the case especially if the heating surface carrier element is formed of several layers which are connected with each other like a sandwich.

Therefore, in accordance with an added feature of the invention, the carrier element is formed of a plurality of interconnected, sandwiched together layers.

In accordance with an additional feature of the invention, the carrier element includes at least one relatively thin steel plate, a relatively thick aluminum layer having a surface, and an insulating layer disposed on the surface onto which the at least one heating conductor strip is applied.

In accordance with still another feature of the invention, the insulating layer is in the form of enamel disposed on the surface of the aluminum layer.

In accordance with still a further feature of the invention, the carrier element includes at least one relatively thin steel plate, a relatively thick aluminum layer having a surface, and an insulating layer disposed on the surface onto which the at least one heating conductor strip is applied. This is advantageous with respect to good heat transfer.

In accordance with still an added feature of the invention, there is provided an insulating layer disposed on the at least one heating conductor strip, and a reinforcing or stiffening aluminum body, such as a ribbed body, with a small thermal mass fastened on the insulating layer. This is done in order to increase the stability of the heating element as a whole.

In accordance with still an additional feature of the invention, the carrier element is formed of aluminum and including a steel plate, preferably having ribs formed thereon, connected to the carrier element by friction or pressure welding. Such a heat surface carrier element of aluminum, or a similar relatively soft material, provides this possibility.

In accordance with yet an added feature of the invention, there is provided another carrier adhesively connected or cast or molded to the carrier element, the other carrier being formed of a material from the group consisting of steel, glass and glass-ceramic.

In accordance with yet an additional feature of the invention, there is provided an intermediate layer with good heat conducting properties disposed between the carrier element, which represents the cooking station, and the at least one heating conductor strip for compensating for existing uneven surfaces.

In accordance with yet another feature of the invention, there is provided a reflector disposed below the at least one heating conductor strip or below the lower surface of the carrier element for reflecting heat radiation. In this way, the heating effect of the heating element can be enhanced. Such a reflector can be constructed as a separate part, which is disposed directly on the bottom cover layer of the heating element and some distance away from the latter. However, there is also the possibility to apply a metal layer onto the bottom cover layer, or to provide this cover layer with a metal oxide coating.

In accordance with yet a further feature of the invention, there is provided a dish-shaped metallic plate having a depression formed therein with a bottom, the carrier element being supported on the bottom of the depression.

In accordance with a concomitant feature of the invention, the at least one heating conductor strip is in the form of a plurality of heating conductor strips, and the carrier element includes intermediate or edge zones with increased heat-flow resistance, such as where the material is narrowed, between the heating conductor strips or between the heat conductor strips and the carrier element. This provides means for preventing a loss of heat energy by conduction to the surroundings, such as by heat travelling to a metallic carrier element. The heat barriers increase the resistance to the flow of heat and may, for example, be in the form of reduced cross sections of the material.

Other features which are considered as characteristic for the invention are set forth in the appended claims.

Although the invention is illustrated and described herein as embodied in a heating element for thermal heating devices, especially cooking stations, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
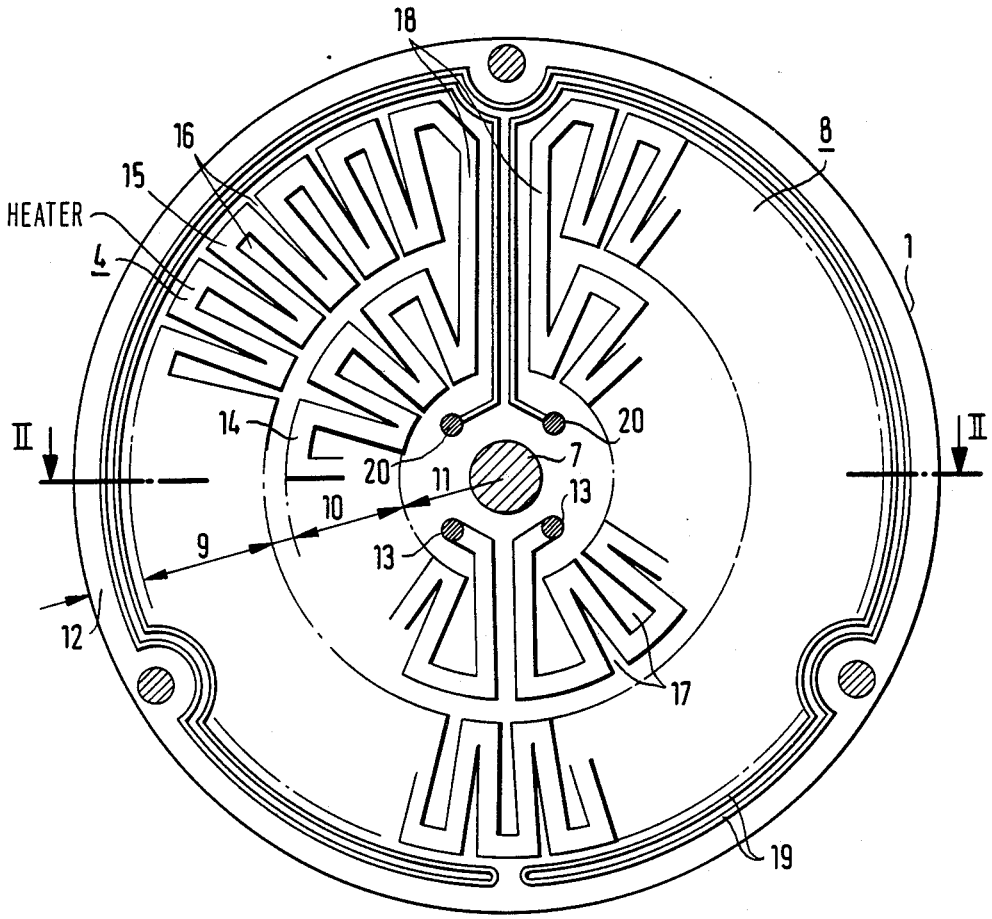
FIG. 1 is a diagrammatic top-plan view of a first embodiment of a heating element for cooking stations according to the invention.
Figure 2:
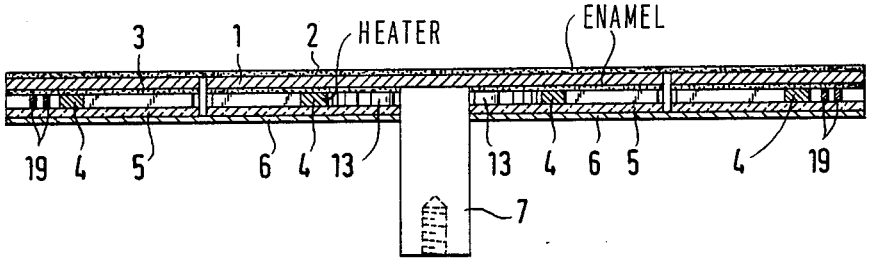
FIG. 2 is a cross-sectional view taken along the line II—II in FIG. 1, in the direction of the arrows.

Referring now to the figures of the drawings in detail and first, particularly, to the embodiment according to FIGS. 1 and 2 thereof, there is seen a circular heating element for a cooking station, which can serve directly or indirectly as a cooking plate heater, such as in connection with a cooking plate or a glass-ceramic plate. A carrier element 1 is provided, which is a flat, smooth steel plate of a material which is heat and scale resistant up to about 700 degrees C and is preferably provided at both sides thereof with enamel coatings 2 and 3. The metallic carrier element 1 is provided with a non-illustrated protective conductor connection. A thick heating conductor strip layer 4 is deposited on the enamel layer 3 on the lower surface of the carrier element 1 in a geometrical configuration which will be explained below, such as by burning it in. If necessary, an insulating cover layer 5 is applied to the conductor 4. The cover layer 5, which may be a glass layer, for example, has a relatively high dielectric resistance at 1250 V. A reflector layer 6, such as in the form of a metal-oxide layer, a metal foil or the like, is disposed directly on or spaced from the lower surface of the cover layer 5. A bolt 7 for fastening is provided in the center, extends through the above-mentioned layers and is welded to the carrier element 1. The bolt 7 serves for mechanically securing the heating element, such as in a cooking station of the above-mentioned type.

As is shown in FIG. 1, a cooking surface 8 is subdivided into two heating zones, namely an outer heating zone 9 and an inner heating zone 10. The cooling surface also has a non-heated innermost zone 11 and a non-heated outermost edge zone 12. The radial width of the zones 9, 10 and 11 each corresponds to a third of the radial width of the cooking area 8. The heating conductor strip 4 has connecting or contacting surfaces 13 in the innermost non-heated zone 11 and respective mutually concentric annular sections 14, 15 in the outer heating zone 9 and the inner heating zone 10, in which the heating conductor strip 4 is disposed in a meander-like pattern. As shown in FIG. 1, gaps 16 between the meander windings of the section 15 are smaller than gaps 17 between the meander windings of the section 14 while the cross section of all of the sections is always the same. In this way the heating effect of the outer section 15 (the specific heating area load of the outer section) is greater than that of the inner section 14. The two sections 14 and 15 are electrically connected with each other through a connecting section 18.

An electrical measuring resistance path or strip 19 is disposed on the carrier element 1 within the non-heated edge zone 12 as a thick layer-heat conducting path or strip, and electrical connecting or contacting surfaces 20 are disposed in the non-heated innermost zone 11. The temperature of the outer section 15 of the heating element 4 is measured by means of this measuring resistance, which may be formed, for instance, of pure nickel and may have a measuring resistance of 300 to 550 Ohms, so that this measuring resistance can be maintained at a predetermined measuring voltage and currents of different strength are obtained due to resistance changes at different temperatures, which can serve to control and regulate the heating power output. It is also possible to provide protection against over-heating temperatures with the aid of the measuring-resistance path or strip 19, which guarantees that the thermal load of the heating area does not exceed a predetermined critical temperature.

The material for the heating conductor strip 4 can be tungsten, platinum, or a suitable alloy which is scale-resistant at temperatures in the order of up to 800 degrees C. Obviously, it is possible within the scope of the invention to obtain different heating effects in the various different zones by changing the cross sections of the heating conductor strips in these zones. It is advantageous with respect to manufacturing if the layer thickness of all of the heating conductor strips or pathways is constant. Furthermore, it is advantageous if the heating conductor strips are constructed in such a way that with a diameter of the surface 8 of 145 mm, it has about 9.7 W/sq cm.

Figure 3:
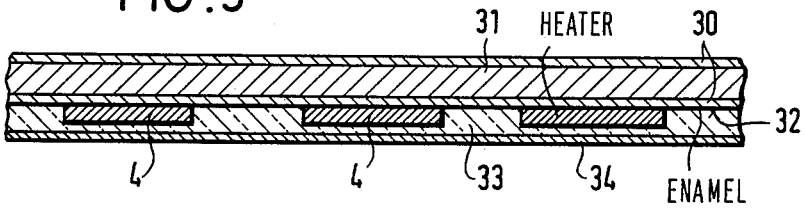
FIGS. 3 to 9 are cross-sectional views of seven additional embodiments.

In the embodiment according to FIG. 3, a somewhat stronger aluminum layer 31 is disposed between two steel plates 30. In this case, at least the lower steel plate 30 is provided with an enamel layer 32. The heating conductor strips 4 are printed and burned or baked into the enamel layer 32. A lower cover layer 33 which may be formed of an enamel layer or a glass enamel layer is again provided. A reflector 34 is disposed either directly on or at a distance from the lower surface of the cover layer 33.

Figure 4:
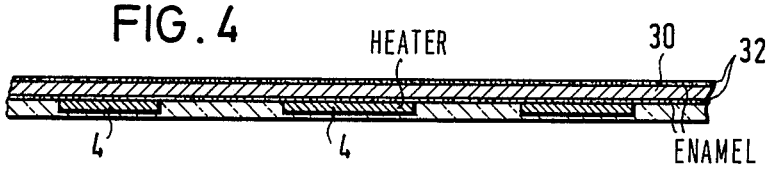

In the embodiment according to FIG. 4, a steel plate 30 is provided with enamel layers 32 on both sides. The heating conductor strips 4 are again applied to the lower enamel layer and are again covered by an enamel or glass enamel layer. This symmetrical coating of the sheet metal or steel plate 30, prevents the steel plate 30 from becoming distorted when strongly heated, i.e. during the operation of the heating element.

Figure 5:
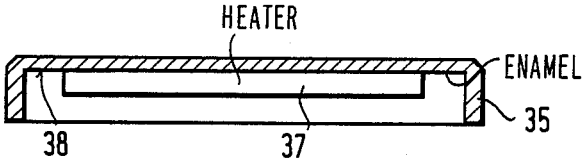
Figure 6:
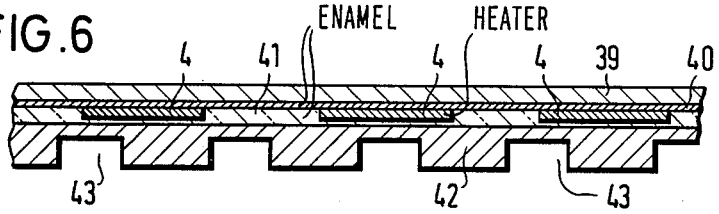

FIG. 5 shows a cooking plate 35 which may be in the form of a cast cooking plate, that can be fastened in the conventional manner on a cooking plate station, which may be made of sheet metal, glass ceramic or glass, for example. If the heating conductor strips or pathways are to be disposed directly on a lower or bottom surface 38 of the cast cooking plate 35, i.e. if the cast cooking plate 35 serves directly as the carrier element, the lower surface 38 is provided with an enamel layer. In this case it is advantageous to use a material which contains little carbon for the cast cooking plate 35, in order to facilitate the enameling process. However, it is also possible to place a heating element 37 of the above-described type directly on the lower surface 38 without an enamel layer, such as by gluing or cementing it, or by clamping it in some non-illustrated manner. If the heating element has an aluminum surface, such as is shown in FIG. 6, for example, it can be connected with the metallic material of the cast cooking plate 35 by friction welding. Preferably, a heating element is used in this case which is similar to the one shown in FIG. 6. In FIG. 6, an electrically insulating layer 40 which may be formed of ceramic, teflon, enamel or which may be anodized, for example, is applied to an aluminum plate 39 and serves as a heating surface carrier element and carries the heat conductor strips or pathways 4. An additional insulating layer, such as an enamel layer 41 is applied onto the layer 40. The aluminum body is provided with ribs for mechanical stiffening of the above-described unit, i.e. the lower surface thereof has recesses 43 formed therein, so as to present very little thermal mass. Obviously, in all of these embodiments, it is possible exists to place a reflector at the bottom in the above-described manner. Similar to the previously described units, a stable sandwich-like component is also provided in this case.

Figure 7:
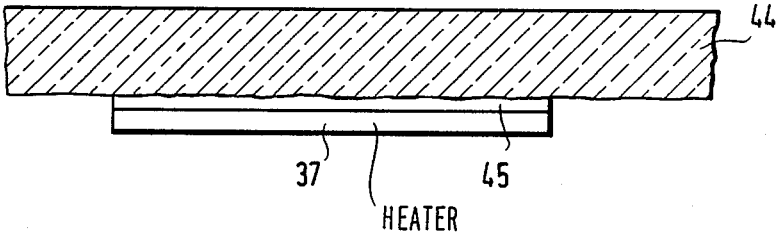

In the embodiment according to FIG. 7, a heating element 37 of the above-described type is disposed at the lower surface of a glass ceramic plate 44. In order to compensate for uneven spots at the bottom of the glass ceramic plate 44, an intermediate layer 45 such as aluminum, which is a good heat conductor, is provided and the heat element 37 is disposed on the layer 45.

Figure 8:
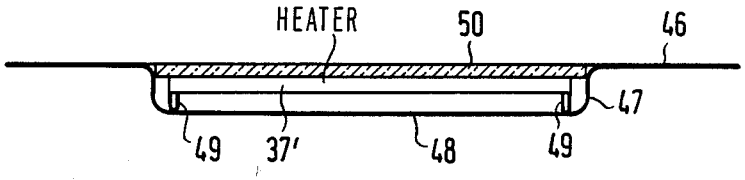

The embodiment according to FIG. 8 illustrates a dish-shaped cooking plate 46 of a cooking station, which is made of sheet metal, for example stainless steel. At the level of the heating surface, the cooking plate 46 has a downwardly deepened depression 47 with a bottom 48. A heating element 37' is positioned in the depression 47 and edges 49 of the uppermost heating surface carrier element thereof which are in the form of a steel or aluminum plate, are pulled downward and rest on the bottom 48.

A cover plate 50 has a large area which lies on the heating element 37' or is connected thereto; the cover plate 50 is flush with the plane of the cooking plate 46. The cover plate may be formed of glass or a glass ceramic material. The depression 47 stabilizes the heating element 37' and a reflector and/or a heat barrier or barrier material can again be disposed in the intermediate space between the heating element 37' and the bottom 48.

Figure 9:
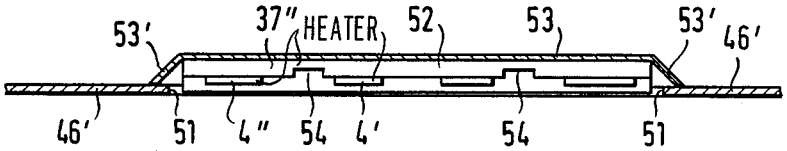

In the embodiment according to FIG. 9, a dish-shaped cooking plate 46' is again provided, but with an opening 51. A heating element 37'' is disposed at the level of the opening 51 or it dips into the opening and it is again provided with heat conductor strips or pathways 4 and a heating surface carrier element 52. A carrier element 53 is connected with the upper surface of the heating surface carrier element 52, so that an edge zone 53' thereof is bent at an angle downward and rests practically in a line on the cooking plate 46'. In this way a zone with increased heat-flow resistance is created between the heating element 37'' and the dish-shaped cooking plate 46', so that a loss of heat energy toward the sides is avoided to a great extend. As is indicated in FIG. 9, the heating element 37'' has an annular inner heating zone with an annular heat conductor path or strip 4'' and an outer heating zone which also has an annular heat conductor path or strip 4'' which is also separated therefrom. This embodiment is suited for so called "zone heating", wherein the heat conductor strips can be energized together or separately. In order to concentrate and limit the heat energy of the inner heating zone, i.e. the heat conductor path or strip 4', to the associated annular zone, a heat barrier in the form of an annular groove 54 is provided around the inner heating zone. This material constriction creates an intermediate zone with increased resistance to the flow of heat.

We claim:

1. Heating element for thermal household appliances, comprising a sandwich structure including:

a heating element layer formed of insulating material having flat heating conductor strips constructed according to a thick film paste technique embedded in said heating element layer;

an inherently stable metal carrier element having a heating surface in close thermal contact with and supporting a substance to be heated and an insulation layer facing said heating element layer above said heat conductor strips; and a reflector layer disposed directly below said heating element layer;

said heating element layer, said carrier element and said reflector layer of said sandwich structure being rigidly connected to each other.

2. Heating element according to claim 1, wherein said carrier element is a metal plate having two sides, and including enamel coatings disposed on both of said sides of said metal plate, said heat conductor strips being disposed on one of said enamel coatings.

3. Heating element according to claim 1, wherein said carrier element includes at least one relatively thin steel plate, a relatively thick aluminum layer having a surface, and an insulating layer disposed on said surface onto which said at least one heating conductor strip is applied.

4. Heating element according to claim 1, including an insulating layer disposed on said heating conductor strips, and a reinforcing aluminum body with a small thermal mass fastened on said insulating layer.

5. Heating element according to claim 1, including an intermediate layer with good heat conducting properties disposed between said carrier element and said heating conductor strips for compensating for existing uneven surfaces.

6. Heating element according to claim 1, wherein said carrier element includes intermediate zones with increased heat-flow resistance between said heating conductor strips, and said intermediate zones with increased heat-flow resistance are in the form of narrowed portions of said carrier element.

* * * * *